US005647448A

United States Patent [19]

Skaggs

[11] Patent Number: 5,647,448

[45] Date of Patent: Jul. 15, 1997

[54] DRILL BIT HAVING A PLURALITY OF TEETH

[76] Inventor: Roger Dean Skaggs, 323 Church St., Bonne Terre, Mo. 63664

[21] Appl. No.: 585,025

[22] Filed: Jan. 11, 1996

[51] Int. Cl.[6] ..... E21B 10/42; E02F 3/00

[52] U.S. Cl. ..... 175/421; 37/460

[58] Field of Search ..... 175/345, 348, 175/351, 397, 421; 37/450, 451, 452, 453, 459, 460

[56] References Cited

U.S. PATENT DOCUMENTS

| | | | |
|---|---|---|---|
| 1,835,701 | 12/1931 | Edmunds . | |
| 1,982,585 | 11/1934 | Vodoz | 175/421 |
| 2,114,799 | 4/1938 | McGlaughlin | 175/421 |
| 2,341,237 | 2/1944 | Phipps | 175/421 |
| 2,608,111 | 8/1952 | Ratkowski | 37/460 X |
| 2,815,933 | 12/1957 | Dionisotti | 175/420.1 X |
| 3,529,677 | 9/1970 | Stephenson . | |
| 4,129,952 | 12/1978 | Olson | 37/118 |
| 4,187,626 | 2/1980 | Greer et al. | 37/141 |
| 4,858,704 | 8/1989 | McDonald et al. | 175/61 |
| 4,953,642 | 9/1990 | Skaggs | 175/393 |
| 4,993,503 | 2/1991 | Fischer et al. | 175/62 |
| 5,067,262 | 11/1991 | Stiffler et al. | 37/452 |
| 5,081,774 | 1/1992 | Kuwano | 37/460 |
| 5,242,026 | 9/1993 | Deken et al. | 175/62 |
| 5,502,905 | 4/1996 | Cornelius et al. | 37/460 |
| 5,526,593 | 6/1996 | Coppage | 37/452 |

*Primary Examiner*—Frank Tsay
*Attorney, Agent, or Firm*—Haverstock, Garrett and Roberts

[57] ABSTRACT

A drill bit for placement on a trenchless drill, the drill bit having a substantially rectangular construction, opposed side edges, a front end edge angularly related to the side edges, and a back end edge opposite the front end edge, opposed faces, with the edges having holes located therein and a cutting tooth press punched into each of the holes to form interference fits between the cutting teeth and the drill bit, the drill bit further having mechanism for attachment of the drill bit to the trenchless drill.

13 Claims, 2 Drawing Sheets

DRILL BIT HAVING A PLURALITY OF TEETH

BACKGROUND OF THE INVENTION

The idea of having a drill bit designed for use on a trenchless drill is known. Typically, the prior art drill bits have had carbide strips attached as wear plates, which are placed on portions of the drill bit that are subject to wear and tear associated with drilling. The prior art drill bits are typically designed to rub their way through different types of ground conditions as opposed to cutting through the earthen material like the present drill bit. Thus, the prior art drill bits need the carbide strips attached as wear plates so as to increase the drilling life of the drill bit. The rubbing associated with the drilling by the prior art drill bits creates friction which causes substantial wear and tear on the prior an drill bits and frequently causes the carbide strips to shatter or break down. Thus, even though the prior art drill bits have wear plates they still wear down at a rate that requires the drill bits to be replaced frequently, which is costly to the user. This is disadvantageous as it means that the user must frequently replace the drill bit which leads to increased cost, low productivity, and increased maintenance.

The present drill bit is advantageous because it uses wear resistant teeth or cutting members in place of wear plates made of carbide strips. The teeth allow the present drill bit to grind, cut, and scratch its way through the rock and earthen material, as opposed to rubbing through the earthen material. The cutting action of the present drill bit is more efficient than the rubbing action of the prior art drill bits in part because less energy is required to power the drill bit through the earthen material. Furthermore, the teeth on the present drill bit allow it to drill through more feet of earthen material before wearing out, as compared to the prior art drill bits. The teeth are advantageous because scratching or cutting through earthen material is much easier than rubbing through earthen material. Thus, the present drill bit has increased longevity, lower maintenance, and is cheaper to use because it has to be replaced less frequently.

Previously, some materials could not be readily drilled with a trenchless drill because the drill bit would wear out too quickly. The prior art drill bits have difficulty drilling through earthen material such as limestone, hardpan, sandstone, and other similar types of earthen materials. The present drill bit, however, can drill through the above mentioned types of earthen materials because of the hardened teeth and their locations on the present drill bit. The present drill bit can drill through earthen materials which typically could not be drilled with previously known drill bits associated with trenchless drilling. The teeth are also advantageous on the present drill bit because they allow more pressure to be placed against the present drill bit which allows the bit to rotate at a higher R.P.M. than known prior art drill bits. As a result, the present drill bit can scratch and cut its way through earthen materials at a faster rate than known prior art drill bits.

The prior art drill bits suffer from being unable to drill through certain materials and also break down at a rate that makes the drill bits expensive to use. Thus, the prior art drill bits limit the types of earthen material that can be drilled with a trenchless drill.

SUMMARY OF THE INVENTION

The present invention resides in a drill bit designed primarily for use on a trenchless drill, with the drill bit having a plurality of wear resistant teeth or cutting members placed at strategic points on the drill bit. The drill bit is typically connected to a trenchless drill which bores holes in the earth so that cables, pipes, and other similar objects can be placed underground. The teeth on the drill bit initially contact the earthen material being drilled, with the teeth partially breaking and grinding the earthen material so that the body of the drill bit comes in contact with the earthen material in a broken state. By allowing the drill bit body to come in contact with the earthen material in a broken state this allows for easier grinding by the body of the drill bit and thus prevents the drill bit from wearing out as fast as other known drill bits. The teeth are advantageous because they allow the present drill bit to last longer than known prior art drill bits used for the same purpose. Also, the cutting teeth allow the drill bit to drill through the earthen material at a faster rate than known prior art drill bits used for the same purpose.

In addition to the wear resistant teeth, one of the preferred constructions of the present drill bit includes a generally rectangular body having a front end edge, opposed side edges, a back end edge opposite the front end edge, and opposed faces. The edges preferably have spaced holes located therein, with the holes receiving the teeth so that the teeth form interference fits with the drill bit body. The holes are located typically at strategic points that allow the teeth to prevent premature degradation of the drill bit body. The drill bit is attached to the trenchless drill near the back end edge and can be attached in a number of ways, including attaching the drill bit to the trenchless drill with threaded members or similar devices. In a further preferred embodiment, a portion of the drill bit body located near the front end edge may be angularly related to a portion of the drill bit body located near the back end edge. The angled portion forms a duckbill shape that is desirable because it allows the drill bit to bore a tunnel larger in diameter than the diameter of a tunnel drilled with a drill bit that is flat from the back end to the front end. While the most preferred construction of the drill bit is duckbill shaped, alternative constructions may be used as long as the drill bit has at least one cutting edge having cutting teeth placed therein.

The wear resistant teeth or cutting members may be made from any of a variety of materials, especially different types of metals, with the teeth preferably made from a material such as tungsten carbide. Tungsten carbide is a very hard, tough metal and is thus advantageous for forming the teeth. The toughness of the tungsten carbide adds to the longevity of the present drill bit by allowing the teeth to wear down at a slower rate, as compared to teeth made from other metals. The tungsten carbide teeth are press punched or forced into the holes located in the edges of the drill bit, thereby forming an interference fit between each of the tungsten carbide teeth and the drill bit body. Other ways, however, of attaching the teeth to the drill bit may be used, such as brazing or screwing the teeth into the drill bit. Press punching is preferred because it is an easy way to place the teeth into the drill bit body and forms interference fits between the teeth and the drill bit body. Interference fits are desirable because they provide for a strong connection between the teeth and the drill bit body. Also, interference fits preferably form a permanent connection between the teeth and the drill bit body which is advantageous as this prevents the teeth from having to be replaced.

The drill bit is preferred for use on trenchless drills because it lasts longer and cuts through the earthen material at a faster rate than other known drill bits used for similar purposes. The advantages of the present drill bit are primarily attributable to the teeth placed at strategic points on the drill bit, with the teeth forming interference fits with the drill bit body.

OBJECTS OF THE INVENTION

An object of the invention is to provide a drill bit having an increased drilling life that can be used on a trenchless drill.

Another object of the invention is to provide a drill bit capable of drilling through earthen materials at a fast rate than other known drill bits.

Yet another object of the invention is to provide a drill bit designed for cutting and grinding through earthen material.

Another object of the invention is to provide a drill bit that requires less energy to drill through earthen material.

DETAILED DESCRIPTION OF THE PREFERRED EMBODIMENTS

Figure 1:
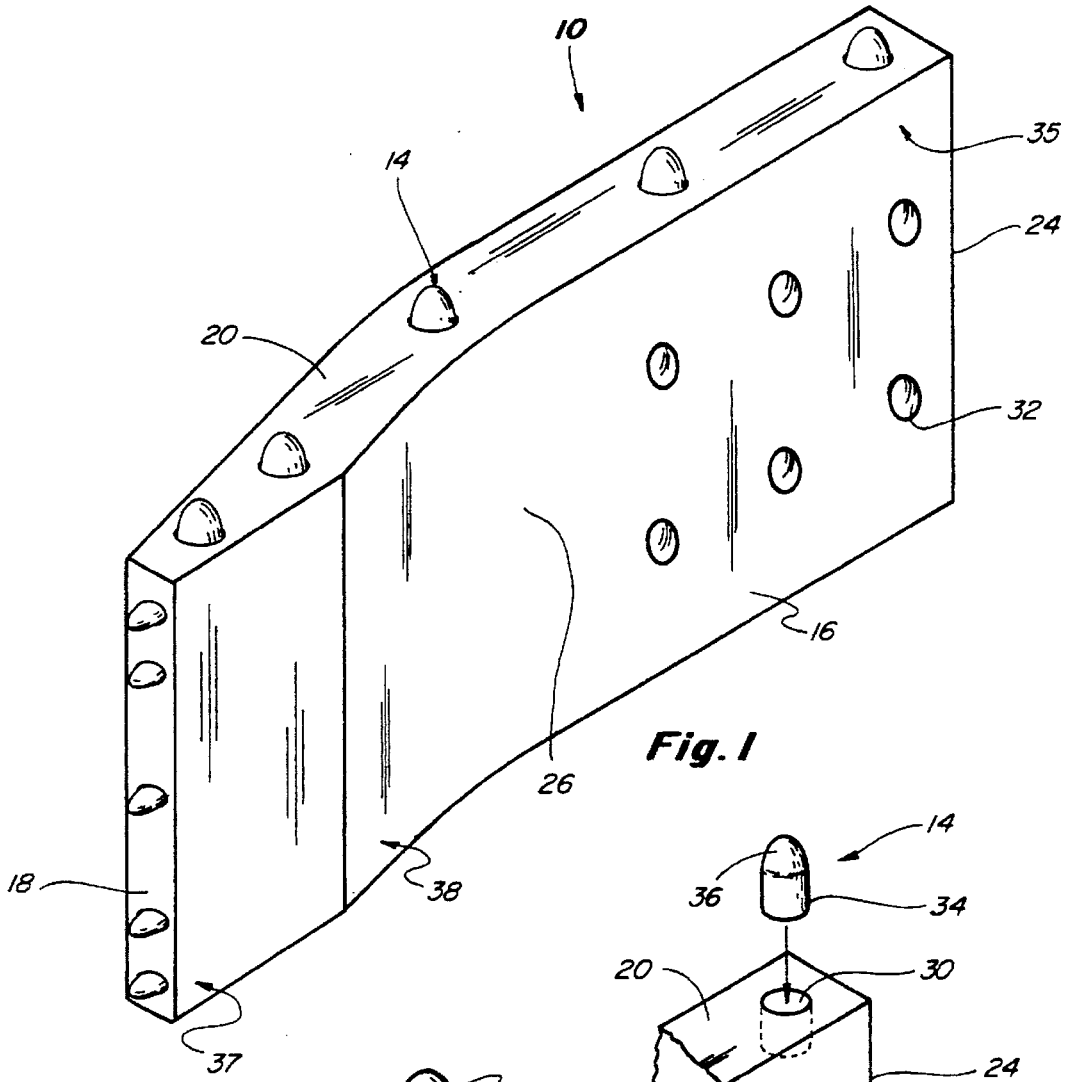
FIG. 1 is a perspective view of the drill bit, including the cutting teeth.

Referring to the drawings more particularly by reference numbers, number 10 in FIG. 1 shows a drill bit that is designed for attachment to a trenchless drill. The drill bit 10 is shown in a functional arrangement with a trenchless drill 12, in FIG. 2, with the trenchless drill used to bore holes in the earth so that pipes, wires, cable, and other similar items can be placed underground without having to dig an open trench.

Figure 5:
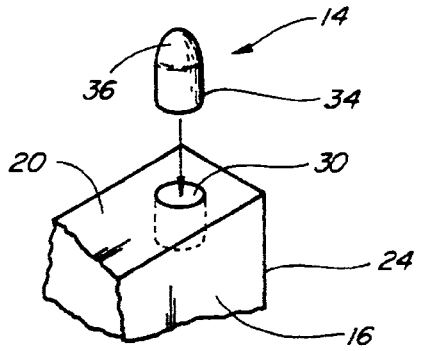
FIG. 5 is a fragmentary view of a cutting tooth in position to be press punched into a hole located in the body of the drill bit.

The drill bit 10 shown in FIG. 1 is one of the preferred constructions and includes a substantially rectangular body 16 having a plurality of hard, wear resistant teeth or cutting members 14 placed at strategic points in the body of the drill bit. The teeth 14 placed in the drill bit engage the surface being drilled and partially crush and grind the earthen material before it reaches the body 16 of the drill bit, thereby increasing the longevity of the drill bit and the speed of drilling. The drill bit 10 includes a front end edge 18, opposed side edges 20 and 22 which are shown substantially perpendicular to the front end edge 18, a back end edge 24 opposite the front end edge 18, and opposed faces 26 and 28, shown in FIGS. 1–4. The side edges 20 and 22 and the front end edge 18 each have a face portion which is shown having a substantially flat construction with each having a plurality of spaced holes 30 drilled or formed therein for receipt of the teeth 14. Thus, as shown in FIG. 5 one of the side edges 20 has a hole or cavity 30 drilled therein, with the hole receiving a tooth 14. The teeth 14 are preferably press punched into the holes 30 to form interference fits between the body 16 and the teeth. When in use the teeth 14 partially break up the earthen material before the earthen material reaches the body 16 of the drill bit 10, with the initial breakage of the earthen material by the teeth 14 reducing wear on the drill bit body 16. Thus, the teeth 14 initially grind and break up the earthen material before the body 16 of the drill bit 10 comes in contact with the earthen material.

Figure 2:
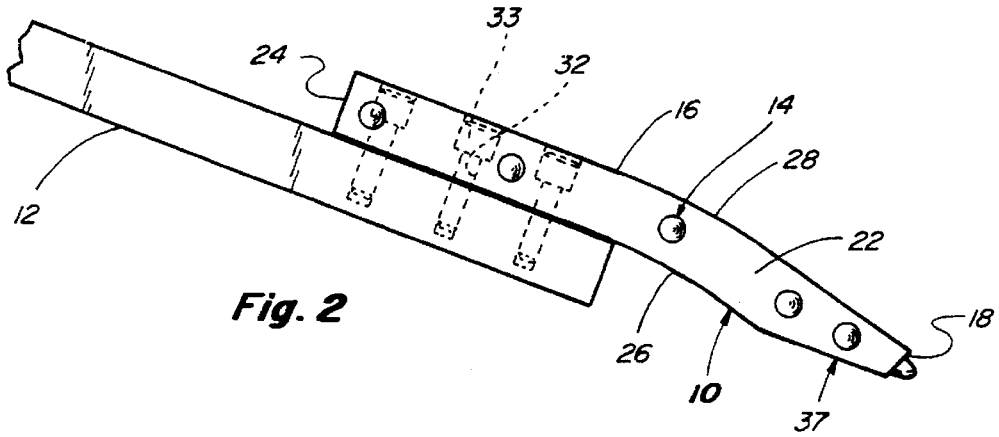
FIG. 2 is a side view of the drill bit attached to a trenchless drill by a plurality of bolt members.
Figure 3:
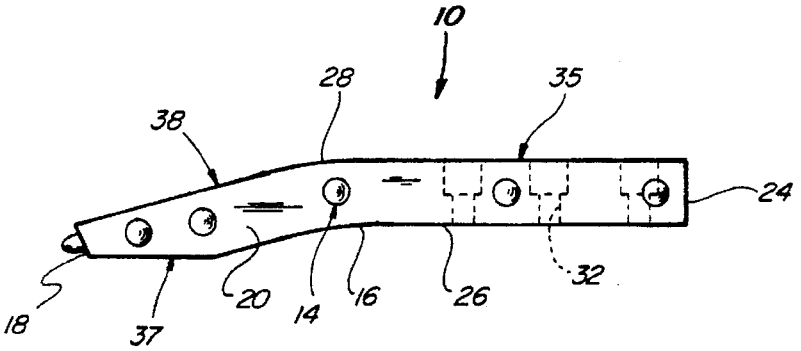
FIG. 3 is a side view of the drill bit showing the cutting teeth and the bolt holes for attaching it to a trenchless drill in dotted outline.
Figure 4:
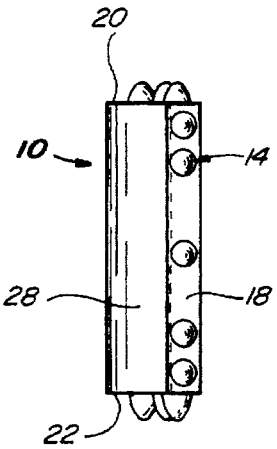
FIG. 4 is a front view of the drill bit showing the cutting teeth.

The drill bit body 16 includes means for attaching the drill bit to a trenchless drill 32, with the means for attachment located near the back end edge 24 of the drill bit body. The means for attachment, as shown, includes a plurality of holes 32 that pass through the drill bit body 16 between the opposed faces 26 and 28, which receive bolts or threaded members 33 that pass therethrough and allow for attachment to a trenchless drill 12, as shown in FIGS. 2 and 3. Also, as shown in FIG. 2, the preferred attachment means includes hex head bolts 33 to attach the drill bit 10 to the trenchless drill 12. FIG. 2 also shows the bit 10 mounted on the forward end portion of a rotatable support member located on a trenchless drill machine or the like. The drill bit body 16 is made from a hardened material such as 4340 alloy, and preferably the teeth 14 are made from a material that is even harder and more wear resistant than the body, such as tungsten carbide.

One preferred form of the subject drill bit is shown in FIG. 3 and includes an elongated substantially rectangular drill bit 10 having two angularly related portions 35 and 38. The drill bit has holes 32 located near the back end edge 24, which receive the threaded members or bolts 33 and connect the drill bit to a drilling device or trenchless drill. The holes 32 are aligned with corresponding openings in the drilling device and the number of holes for making the attachment can be varied depending upon the forces involved. The front end portion 38 of the body 10 is shown angularly related to the rear portion 35 at an angular relationship somewhere between approximately 11° and 22°, but this angle can be greater or less than the specified range depending upon circumstances. It can now be understood that if the trenchless drill on which the drill bit 10 is mounted rotates the drill bit, the size of the opening or ground tunnel produced will be larger in diameter than would be produced if a flat bit body were used. The present drill bit 10 therefore can make a hole that is larger in diameter than the hole that would be produced if the subject bit were flat along the full length of the bit. However, in either case, the hardened teeth 14 mounted in the leading edge 18 and in the side edges 20 and 22 will be the portions that engage the work as the bit is rotated and the teeth will cut up and fragmentize the earthen surfaces they come in contact with and in so doing will reduce or partially prevent the body 10 from rubbing on the surface being drilled. This is an important factor to the present invention because rubbing as compared with fragmentizing requires considerably more power and also produces considerably more body wear and more frequent bit replacements. It has been found in practice that the subject construction produces more efficient drilling and extends the life of the bit substantially because of the way that the teeth engage and break up the ground or rock as the bit is rotated on a machine. The bit shown in FIGS. 1–3 represents an important advantage over known bits, as it is more efficient and requires less power to operate.

The body 16 of the drill bit 10 is preferably made from a material such as 4340 alloy steel, however, other hardened materials may be used such as various ceramics and metal compositions. The use of 4340 alloy steel has been found to produce very good results for the purposes of the present drill bit 10. The selection of the materials will depend in part upon the type of earth or rock through which the subject bit is to be used. It has been found in practice that the teeth in the present bit remain attached to the body and prolong the life of the drill bit. Regardless of the material used, the drill bit body 16 must be capable of withstanding typical drilling conditions associated with trenchless drilling, such that the drill bit 10 must be capable of cutting through rock and earthen material. 4340 alloy is preferred for most applications because it is a hard, durable metal and thus the alloy promotes longevity in the drill bit 10. Furthermore. 4340 alloy is beneficial because it can withstand contact with many earthen materials commonly encountered in trenchless drilling and also allows the cutting teeth 14 to be readily press punched into the drill bit body 16. Thus, 4340 alloy is preferred because it has sufficient hardness to contribute to the increased longevity of the drill bit and can have teeth readily press punched into the drill bit body.

Figure 6:
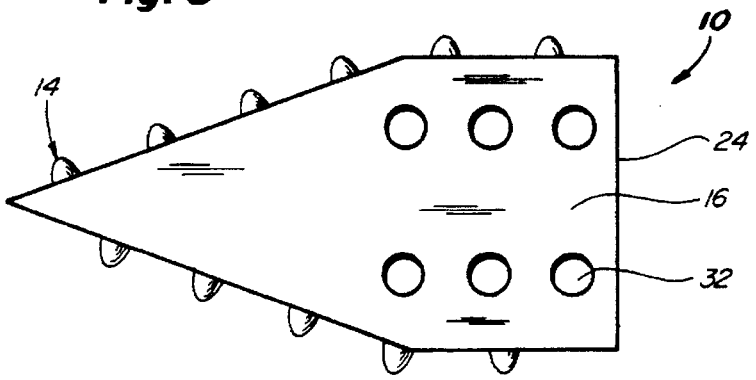
FIG. 6 is a top view of an arrow shaped drill bit.
Figure 7:
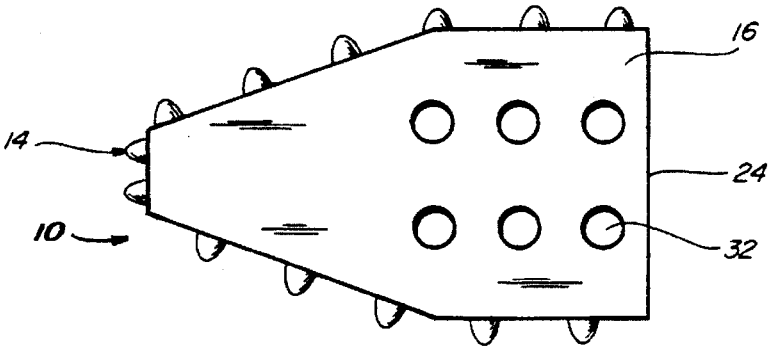
FIG. 7 is a top view of a drill bit having five cutting edges.
Figure 8:
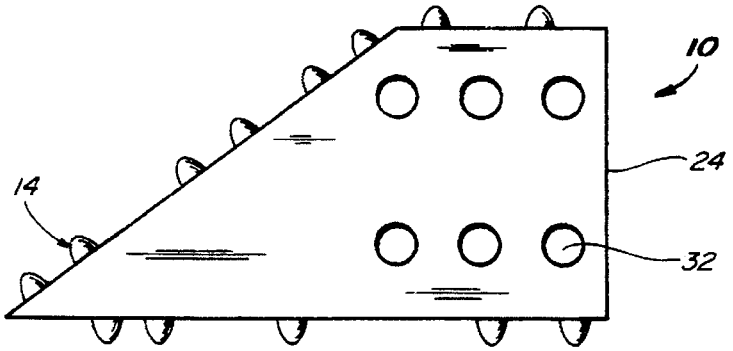
FIG. 8 is a top view of a drill bit having a wedge shaped cutting edge.

The subject drill bit may have a number of different shapes, some of which are shown in FIGS. 6, 7, and 8. Depending upon the shape desired, will determine where the teeth are to be located. In the constructions shown in FIGS. 6, 7, and 8, most, if not all, of the teeth are located on side or edge surfaces of the bit as distinguished from locating them on the front end edge 18 of the bit 10 as shown in FIGS. 1 and 2. Also, the constructions shown in FIG. 6, 7, and 8 do not have angularly related portions such as the portions 35 and 38 in FIGS. 1 and 2, although this possibility is not ruled out depending upon the shape that is selected for a particular job. Depending upon the construction selected for a particular job will determine where on the bit body 16 the teeth 14 will be located and also the number of teeth required on the various surfaces. All of the constructions shown, however, have the teeth located on side edges, thereby allowing them to readily contact the earthen material.

As stated before, it is preferred for the drill bit 10 to have a substantially rectangular shape with angularly related portions 35 and 38. The drill bit, however, may have a variety of other shapes including a drill bit having only one edge. Thus, the drill bit body 16 may have only one edge or a plurality of edges. As can be seen in FIGS. 6, 7, and 8 the body of the drill bit may have a variety of different constructions. Regardless of the construction and the number of edges located on the drill bit 10, each work engaging edge or edges must have at least one tooth 14 located therein. As mentioned previously, the preferred shape of the drill bit body has opposed faces, opposite side edge faces, opposite end edge faces, with the side edge faces and the end edge faces extending around the periphery of the drill bit body.

In another preferred embodiment, the oblique or angled portion 38 may be made narrower and or thinner by beveling the drill bit at a point near the front end edge 18, as shown in FIGS. 1–3. The narrowed portion 37 allows the drill bit to more easily push into the earthen material so that the beveled portion performs a function similar to a spade.

The holes 30 located in the cutting edge or edges are spaced apart and may be of a variety of shapes, sizes, and depths, with the holes 30 corresponding to the number of teeth to be press punched into the drill bit 10. The shape of the holes may be cylindrical as shown or may have other constructions capable of receiving a cutting member. The shape of the holes is dependent upon the shape of the cutting members 14 placed into the body 16 of the drill bit 10. The preferred shape of the holes, however, is cylindrical as shown in FIG. 5. Regardless of the shape, it is preferred for each of the holes 30 in the edges 18, 20, and 22 to have slightly smaller diameters than the diameter of the body portion 34 of each cutting tooth 14. The diameter of the holes 30 is typically between about one half thousandths of an inch and four thousandths of an inch smaller than the diameter of the cutting teeth 14. The preferred diameter is about two thousandths of an inch smaller than the diameter of the teeth 14. Thus, the diameter of the teeth 14 must be slightly larger than the diameter of the holes 30 otherwise interference fits cannot be formed between the drill bit body 16 and the cutting teeth. The holes 30 are preferably drilled into the drill bit body 16, however, they may also be formed when the drill bit is cast. The depth of the holes 30 is typically between about one quarter of an inch and three quarters of an inch, with the preferred depth being about one half of an inch. Also, the holes may be formed at an angle in relation to the edges so that when the teeth are placed in the holes the teeth are in an angular relationship with the edges.

Figure 9:
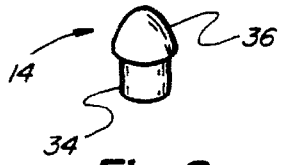
FIG. 9 is a perspective view of a tooth having an enlarged head.

The teeth or cutting members 14 have a tip or head portion 36 and a body portion 34, with the tip portion being the part of each tooth that engages and breaks the earthen material. The body portion 34 is a cylindrical portion integral to the head portion 36, as shown in FIG. 5. The tooth 14 shown in FIG. 5 has a frusto conical tip portion 36 and a cylindrical body portion 34, with the cylindrical body portion being slightly larger than the diameter of the hole in which it is to be press punched. The tip portion 36 may also have a larger diameter than the diameter of the body portion 34 thereby forming an enlarged head portion on each tooth 14, as shown in FIG. 9. In an alternative construction the teeth 14 may be square, with the square body portion being larger than the hole into which it is press punched. Furthermore, the teeth may have other shapes as long as they are capable of adequately cutting through earthen material and protect the drill bit body from excessive wear and tear that leads to premature degradation of the drill bit.

The teeth 14 may be attached to the body 16 in any of a number of ways so long as the teeth are capable of adequately grinding the earthen material and remaining attached to the drill bit 10. Press punching is the preferred way to attach the teeth 14 to the body 16 of the drill bit 10, because interference fits are formed between the teeth and the body which are strong connections and prevent the teeth from loosening, breaking off, or falling out of the body of the drill bit. Also, press punching is an easy way to force the teeth into the drill bit body. Other methods of attaching the teeth 14 to the body portion 16 include brazing the teeth onto the body, screwing or threading the teeth into the body, as well as spot welding the teeth to the drill bit 10.

The teeth 14 are preferably made out of tungsten carbide, as stated, because it imparts desirable hardness, toughness, and wear resistant characteristics to the cutting teeth. Tungsten carbide is also typically much harder than most of the earthen material it cuts. The cutting teeth 14. however, may be made of other materials as long as the teeth are hard enough to permit adequate cutting and grinding. Typically, the teeth 14 are strategically placed in the drill bit to allow for the most efficient cutting and grinding of the earthen material which also helps to prevent the premature degradation of the drill bit body 16. Also, it is preferable for the teeth and the drill bit body to be hard so that the drill bit may have a longer drilling life than other known drill bits used for the same purpose.

Thus, there has been shown and described several embodiments of the drill bit device which satisfy all the objects and advantages set forth above. It will be apparent, however, to those familiar in the art that many changes, variations, modifications and other uses and applications for the subject drill bit device are possible. All such changes, variations, modifications and other uses and applications that do not depart from the spirit and scope of the invention are deemed to be covered by the invention which is limited only by the claims which follow.

What is claimed is:

1. A drill bit for use on a trenchless drill device that allows for drilling through earthen material said drill bit including a metal body having opposed face portions, opposed side edges, a front end edge, and a back end edge opposite said front end edge, said body having means adjacent said back end edge for attachment to the trenchless drill device, said body being elongated between said front end edge and said back end edge, said portion of said body adjacent to said front end edge being angularly related to said portion adjacent to said back end edge, each of said front and said side edges having a plurality of spaced holes formed therein, and a corresponding number of teeth positioned respectively in each of said holes forming an interference fit between each of said holes and said tooth positioned therein, said teeth being made from a material that is harder and more wear resistant than said body.

2. The drill bit of claim 1 wherein said teeth are made of tungsten carbide.

3. The drill bit of claim 1 wherein each of said teeth has a conical portion and a cylindrical body portion, the diameter of said tooth body portion being larger in diameter than the diameter of said holes in which said teeth are positioned so that when said teeth are pressed into said holes interference fits are formed therebetween.

4. The drill bit of claim 1 wherein said teeth have an enlarged head portion projecting outwardly from said drill bit body.

5. The drill bit of claim 1 wherein said metal body is made from 4340 alloy steel.

6. The drill bit of claim 1 wherein said portion of said body adjacent to said front end edge is reduced in cross section.

7. A drill bit for use on a trenchless drill, said drill bit comprising a body made of a hardened material with said body having means for attachment to the trenchless drill and at least one cutting edge having a plurality of cavities, with each said cavity receiving a tooth that is press punched into said cavity to form an interference fit between each said cavity and each said tooth, each said teeth being made from a material that is harder than said body.

8. The drill bit of claim 7 wherein said teeth are made of tungsten carbide.

9. A drill bit for cutting through earthen materials comprising a body having a front portion for engaging the earth being drilled and a rear portion for attachment to a drilling machine, said body of said drill bit having spaced opposite side faces and an edge face extending therearound, said edge face having a forward portion, at least one side portion, and a rear portion, said forward and side edges having spaced openings formed therein, a hardened tooth member positioned in each of said openings and forming an interference fit with said openings in said body, each of said teeth having a portion which extends outwardly from said forward and side edges in which they are positioned to engage and fragmentize earthen material that said drill bit comes in contact therewith.

10. The drill bit of claim 9 wherein the portion of said body adjacent to said forward edge is angularly related to said portion of said portion adjacent to said rearward edge portion.

11. A drill bit for use in drilling holes in the ground comprising:

a metal body having opposite side faces, opposite side edge faces, and opposite end edge faces, said opposite side edge faces and said opposite end edge faces extending around the periphery of said body between said side faces, means on said body for attaching said drill bit to a drilling tool, the improvement comprising mounting a plurality of spaced work engaging teeth in one of said end edge faces and in at least one of the opposite side edge faces, each of said teeth including a head portion and a portion extending therefrom, and a corresponding number of openings formed in one of said end edge faces and in said opposed side edge faces for receiving respective ones of said teeth, said teeth being formed of a material that is harder than said body, the cross-sectional dimensions of the extending portions of said teeth being selected so that they can be forced into said respective openings in said body to form and interference fit therewith.

12. The drill bit of claim 11 wherein said metal body is an elongated member having said means adjacent one of said end edges thereon for attaching it on a drill device the other end edge extending forwardly therefrom for engaging a work surface being drilled, said forwardly extending portion being angularly related to the one end portion.

13. The drill bit of claim 11 wherein each of said teeth members is formed of tungsten carbide and includes a head portion and an integral cylindrical portion, the holes in said body portion being sized to enable receipt of the cylindrical portions of said teeth to form an interference fit therewith when said teeth are forced into said holes.

* * * * *